US012252855B2

(12) United States Patent
Dai et al.

(10) Patent No.: US 12,252,855 B2
(45) Date of Patent: Mar. 18, 2025

(54) MOVABLE WATER-PERMEABLE PILE SPUR DIKE AND OPERATION METHOD THEREOF

(71) Applicants: CHINA THREE GORGES CORPORATION, Beijing (CN); HOHAI UNIVERSITY, Jiangsu (CN)

(72) Inventors: Huichao Dai, Beijing (CN); Jinqiao Mao, Jiangsu (CN); Hanmei Li, Jiangsu (CN); Yiqing Gong, Jiangsu (CN); Jie Dai, Jiangsu (CN)

(73) Assignees: CHINA THREE GORGES CORPORATION (CN); HOHAI UNIVERSITY (CN)

( * ) Notice: Subject to any disclaimer, the term of this patent is extended or adjusted under 35 U.S.C. 154(b) by 0 days.

(21) Appl. No.: 17/778,718

(22) PCT Filed: Mar. 2, 2021

(86) PCT No.: PCT/CN2021/078635

§ 371 (c)(1),
(2) Date: May 20, 2022

(87) PCT Pub. No.: WO2022/016868

PCT Pub. Date: Jan. 27, 2022

(65) Prior Publication Data

US 2024/0003107 A1 Jan. 4, 2024

(30) Foreign Application Priority Data

Sep. 17, 2020 (CN) ..... 202010984671.1

(51) Int. Cl.
*E02B 3/02* (2006.01)
*E02B 3/06* (2006.01)

(52) U.S. Cl.
CPC . *E02B 3/06* (2013.01); *E02B 3/02* (2013.01)

(58) Field of Classification Search
CPC ..... E02B 3/02; E02B 3/06
See application file for complete search history.

(56) References Cited

U.S. PATENT DOCUMENTS

2017/0298585 A1* 10/2017 Carey ..... A01K 79/02

FOREIGN PATENT DOCUMENTS

CN 105839588 A * 8/2016 ..... E02B 3/06
CN 106677121 A 5/2017
(Continued)

OTHER PUBLICATIONS

International Search Report of PCT/CN2021/078635.
Written Opinion of PCT/CN2021/078635.

*Primary Examiner* — Frederick L Lagman
*Assistant Examiner* — Stacy N Lawson

(57) ABSTRACT

The present invention has disclosed a movable water-permeable pile spur dike and an operation method thereof. The pile spur dike includes a fixed rail, a plurality of movable rails, a plurality of movable water-permeable piles, pressure sensors, flow meters and a control platform, wherein the plurality of movable water-permeable piles are arranged on the fixed rail and the plurality of movable rails, the pressure sensor and the flow meter are arranged at each monitoring point on the outer side wall of each movable water-permeable pile, the control platform is used for analysis and calculation according to the monitoring data from each pressure sensor and each flow meter and adjusts the positions of each movable rail and each movable water-permeable pile, so that the water flow velocity and spur dike's pressure at each monitoring point are less than a corresponding flow velocity threshold value and pressure threshold value.

19 Claims, 10 Drawing Sheets

(56) References Cited

FOREIGN PATENT DOCUMENTS

| | | | | |
|---|---|---|---|---|
| CN | 207553030 | U | | 6/2018 |
| CN | 108951539 | A | * | 12/2018 |
| CN | 109778774 | A | | 5/2019 |
| CN | 109853465 | A | | 6/2019 |
| CN | 112144470 | A | | 12/2020 |
| CN | 114922129 | A | * | 8/2022 |
| JP | 2007239321 | A | | 9/2007 |
| RU | 2014381 | C1 | | 6/1994 |

* cited by examiner

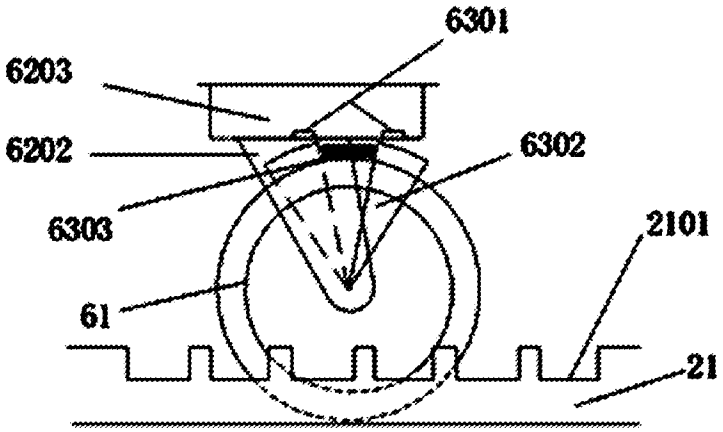
FIG. 7
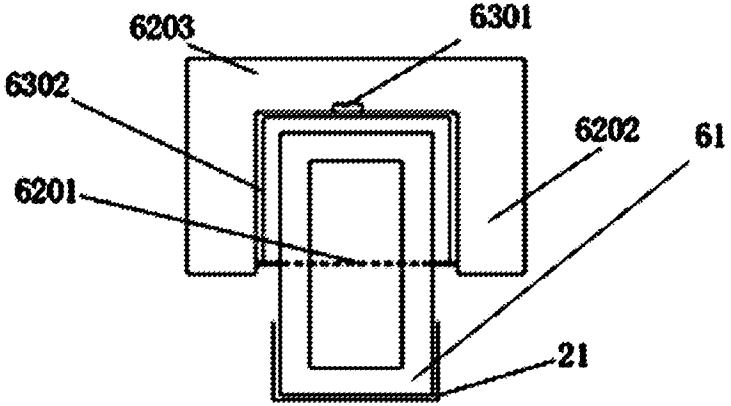

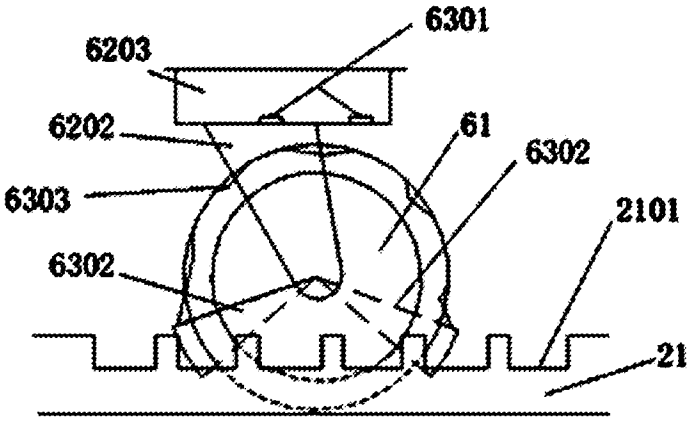
FIG.8
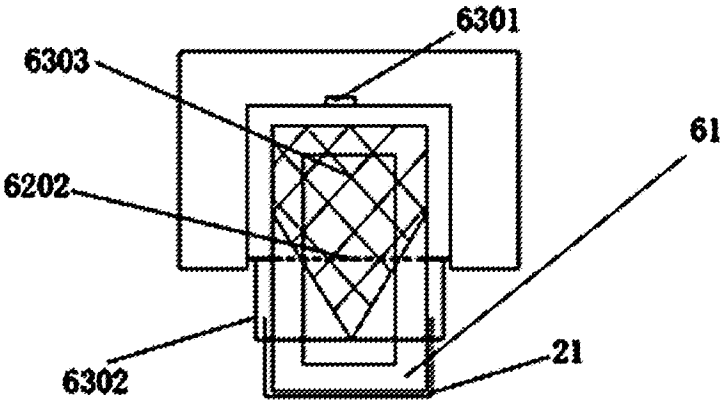

MOVABLE WATER-PERMEABLE PILE SPUR DIKE AND OPERATION METHOD THEREOF

CROSS-REFERENCE TO RELATED APPLICATIONS

This Application is a national stage application of PCT/CN2021/078635. This application claims priorities from PCT Application No. PCT/CN2021/078635, filed Mar. 2, 2021, and from the Chinese patent application 202010984671.1 filed Sep. 17, 2020, the content of which are incorporated herein in the entirety by reference.

FIELD OF THE DISCLOSURE

The present disclosure pertains to the technical field of water conservancy projects, and in particular relates to a movable water-permeable pile spur dike and an operation method thereof.

BACKGROUND OF THE DISCLOSURE

A spur dike is a hydraulic structure widely used in river restoration, with one end connected to an embankment, and the other end deep into the river, showing a "T" shape. As natural rivers usually have navigation obstruction phenomena such as insufficient water depth in dry seasons, dangerous water flow states and dangerous shoals in clusters, as well as frequent inshore erosion phenomenon, the hydraulic structures such as spur dikes perform an important function in reducing scouring damage to river banks caused by direct erosion, removing sand with converging flow, improving waterways, restoring rivers and protecting hydrogeologic diversity.

With epoch development and in-depth research on the flow field around a spur dike, the spur dike can also be gradually sorted into a water-permeable spur dike and a traditional spur dike. Traditional spur dike are mainly a fixed, continuous and water-impermeable gravity spur dike, the bodies of which have complicated water flow structure around them, and majority in the form of a single longitudinal slope, resulting in poor adaptability to the river bank as well as incapability to be easily dismantled once built. Under the long-term erosion of water flow, it is easy to cause the dike head to be eroded and its foundation to be hollowed out, resulting in partial instability of the dike body, which causes huge daily maintenance to the spur dike and reduces in its economic and engineering effects.

Compared with the traditional spur dike, the water-permeable spur dike reduces the scouring erosion of the water flow on the dike body, due to consideration that ecological factors reduces the partition between aquatic organisms and natural bank slopes to a certain extent, it has a better ecological protection function. However, in the case of great changes in annual river environment, due to the constant length and the range-fixed water-permeability of the spur dike, the spur dike is not universally operated, and still lacks a good self-adaptive adjustment capability, which is not beneficial to use the spur dike in the long term. In addition, in the actual project, in order to effectively improve the effect of river restoration, people adopt the method of changing a single spur dike to a spur dike group, but the backflow areas between spur dikes in the spur dike group are fixed, and its adjustment capacity is limited as same as the single spur dike.

In the existing patent such as CN106677121B, the movable water-permeable spur dike structure that prevents seashores from being eroded and adopts a spur dike in the form of several open caissons arranged at intervals, not only has a good coastal erosion-prevention effect, but also can reduce the engineering amount, but it still does not have the rapid adjustment and response mechanism that can be self-adaptive to changes in coastal flow in time. Although the self-lifting spur dike automatically adjusting height according to water level (CN109853465A) can realize automatically adjusting the height of spur dikes and enhance the protection to spur dike foundations, the spur dike still cannot avoid problems in long-term use such as hollowing out of its foundation caused by scouring erosion, and instability of the dike body.

SUMMARY OF THE DISCLOSURE

In order to overcome the deficiencies in the prior art, an objective of the present disclosure is to provide a movable water-permeable pile spur dike, which can be used in a complicated river environment, and can change its shape and water permeability based on control, so as to enhance the stable arrangement of the dike body.

Another objective of the present disclosure is to provide an operation method of a movable water-permeable pile spur dike, which can control the movable water-permeable pile spur dike to form the shape and the water permeability that adapt to the changes of the surrounding environment according to the changes in the flow velocity of rivers and pressure borne by the spur dike, so as to reduce the scouring damage to river banks caused by direct erosion, improve the protection effect and the stability of the movable water-permeable pile spur dike itself, and better meet the requirements of river navigation, flood control and ecological protection.

Technical solution: in order to achieve the above objective, one aspect of the present disclosure provides a movable water-permeable pile spur dike, comprising a fixed rail, a plurality of movable rails, a plurality of movable water-permeable piles, pressure sensors, flow meters and a control platform, wherein one end of each movable rail is slidably connected to one side of the downstream face of the fixed rail, and can move relatively in the extending direction of the fixed rail;

the plurality of movable water-permeable piles are arranged on the fixed rail and the plurality of movable rails;

the pressure sensor and the flow meter are arranged at each monitoring point on the outer side wall of each movable water-permeable pile and respectively used to monitor the changes in the water pressure on each monitoring point and the changes in the water flow velocity about it;

the plurality of movable rail, the plurality of movable water-permeable pile, each pressure sensor and each flow meter are respectively connected to the control platform in a communication mode, which is used for analysis and calculation according to the monitoring data from each pressure sensor and each flow meter and adjusts the positions of each movable rail and each movable water-permeable pile, so that the water flow velocity and spur dike's pressure at each monitoring point are both less than a corresponding flow velocity threshold value and pressure threshold value, and the spur dike's water permeability falls within a setting range.

Preferably, each movable water-permeable pile includes a hollow cylinder, of the hollow cylinder, the upstream face is provided with a plurality of upstream face permeable holes whose diameters increase from top to bottom, and the downstream face is provided with a plurality of downstream face permeable holes whose diameters decrease from top to bottom, each upstream face permeable hole and each downstream face permeable hole penetrate through the water-permeable pile to its hollow, and the upstream face permeable holes and the downstream face permeable holes are completely alternately arranged in the vertical direction.

Preferably, the upper surfaces of the fixed rail and the plurality of movable rail are provided with two or more than two pile-sliding grooves arranged in parallel, two sides of each pile-sliding groove are provided with tooth-shaped grooves;

the bottom of each water-movable permeable pile is provided with two or more than two rows of pile roller groups, each of which corresponds to one pile-sliding groove, and each of which includes one or more than one pile roller unit, each pile roller unit includes a connector, a pile roller and an electromagnetic group, of the connector, the top is embedded inside the mobile water-permeable pile, the middle part is a hollow connecting block, and the two ends of the bottom extend downwards to form connecting pieces, both of which are connected by a connecting rod, the connecting rod passes through the center of the pile roller, a pile-fixing clamp is sleeved on the connecting rod, the electromagnetic group is arranged in the hollow connecting block of the connector, the pile roller and the electromagnetic group are connected with the control platform in a communication mode, so as to be rolled and magnetically adsorb the pile-fixing clamp under the control of the control platform, respectively;

in the case that the electromagnetic group has not magnetically adsorbed the pile-fixing clamp, the pile-fixing clamp is embedded in the tooth-shaped grooves of its rail under the action of gravity, in the case that the electromagnetic group has magnetically adsorbed the pile-fixing clamp, the pile-fixing clamp leaves the tooth-shaped grooves.

Preferably, the pile-fixing clamp includes 2 U-shaped bent iron sheets, the two ends of each U-shaped bent iron sheet are respectively sleeved on the connecting rod, and can rotate around the connecting rod, in the case that the electromagnetic group has not magnetically adsorbed the pile-fixing clamp, the two U-shaped bent iron sheets, under the action of gravity, respectively, are embedded in the tooth-shaped grooves of their rails in the opposite direction.

Preferably, the sides of the two straight ends of each U-shaped bent iron sheet are fan-shaped.

Preferably, the 2 U-shaped bent iron sheets are connected with each other through a telescopic chain net, the telescopic chain net is made from elastic wear-resistant material, in the case that the electromagnetic group has magnetically adsorbed the 2 U-shaped bent iron sheets, the telescopic chain net shrinks, in the case that the electromagnetic group has not magnetically adsorbed the 2 U-shaped bent iron sheets, the telescopic chain net spreads out and covers the surface of the pile roller after its both ends being stretched.

Preferably, the fixed rail is an irregular curved rail, or a broken-line rail formed by splicing multiple segments of straight sub-rails.

Preferably, the lower surface of the fixed rail is provided with one or more than one four-sided hollowed-out pyramid sinking in the river bed, the quadrilateral bottom surface of the four-sided hollowed-out pyramid is embedded in the lower surface of the fixed rail, and has a pyramided outer frame formed by metal wires, each hollowed out surface also has a plurality of metal wires wound across its edges, the plurality of four-sided hollowed-out pyramids are arranged along such three straight lines, as the edges of the corresponding fixed rail and the central axis of the long end, and the four-sided hollowed-out pyramids along the two adjacent straight lines are alternated with each other.

Preferably, one side of the downstream face of the fixed rail is provided with a groove whose inside is provided with a movable rail groove, one end connecting each movable rail to the fixed rail is provided with a moving slider, and the bottom of one end away from the fixed rail is provided with a movable rail roller, which is inlaid into the movable rail groove inside the groove, the movable rail roller is connected with the control platform in a communication mode, and can roll along the matched convex single rail fixed on the river bed under the control of the control platform, thereby driving the moving slider to slide, so as to adjust the position of the corresponding movable rail.

Another aspect of the present disclosure further provides an operation method of the movable water-permeable pile spur dike, comprising the following steps:

(S1) performing statistical analysis based on each inter-annual or annual data results of rivers, setting the water permeability range of the movable water-permeable pile spur dike and the initial position of the plurality of movable water-permeable piles and the plurality of movable rails, arranging the control platform according to the initial position, and controlling and adjusting the plurality of movable water-permeable piles and the plurality of movable rails to form the movable water-permeable pile spur dike in its initial state;

(S2) each flow meter monitoring the flow velocity of water flow that includes longitudinal flow velocity $u_x$ and lateral flow velocity $u_y$, at its monitoring point of the spur dike in real time; of each flow meter, a sampling interval period being denoted by $\Delta t$, a monitoring period being denoted by T, an average longitudinal flow velocity value within the monitoring period T being denoted by $U_x$, and an average transverse flow velocity value being denoted by as $U_y$; each flow meter sending $U_x$ and $U_y$ to the control platform as monitoring data; each of the pressure sensors monitoring the pressure borne by it that includes hydrostatic pressure $P_1$ and hydrodynamic pressure $P_2$, at its monitoring point of the spur dike in real time; of each pressure sensor, a sampling interval period also being denoted by $\Delta t$, a monitoring period also being denoted by T, an average value of the sum of the hydrostatic pressure and the hydrodynamic pressure within the monitoring period T being denoted by P; each of the pressure sensors sending P to the control platform as monitoring data;

(S3) the control platform calculating the real-time water permeability of the movable water-permeable spur dike based on the real-time monitoring data from each pressure sensor and each flow meter according to Formula:

$$a = \frac{\theta \times P \times K_a \times \Sigma L}{D_1 U}$$

wherein, a is the water permeability of the spur dike; $K_a$ is an error-correcting function, which is required to be determined by model tests and prototype observations; $\Sigma L_i$ is the sum of the water-permeable pile's spacing; U is the average water flow velocity of each monitoring point, which is calculated from the data collected by each flow meter, within each monitoring period; P is the average value, which is calculated from the data collected by each pressure sensor, of the sum of the hydrostatic pressure and the hydrodynamic pressure of the spur dike within each monitoring period; $D_1$ is the total length of the spur dike; θ is the water permeability of the water-permeable pile; and (S4) based on the real-time water permeability, the real-time monitoring data of each flow meter, and the real-time monitoring data of each pressure sensor, the control platform adjusting the positional arrangement of the multiple movable water-permeable piles and the plurality of movable rails, specifically including:

judging whether the water flow velocity U at each monitoring point and the pressure P borne by the spur dike within the current monitoring period are both less than a preset threshold;

if both are less than the preset threshold and the real-time permeability is within the water permeability range, keeping the spacing between the water-permeable piles unchanged, that is, the water permeability of the spur dike attaining the stability of the spur dike and having a good response mechanism to water flow;

if the flow velocity U or the spur dike's pressure P at one or more monitoring points within the current monitoring period is more than the preset threshold value, having a disadvantage to stabilize the spur dike, a simulation being done to gradually increase the spacing of the movable water-permeable piles at the corresponding monitoring point until the water flow velocity U and the spur dike's pressure P at each monitoring point are less than the corresponding preset threshold value and the water permeability calculated by simulation falls within the water permeability range, then making an adjustment according to the final simulation results; if the flow velocity U or the spur dike's pressure P at each monitoring point is less than the preset threshold value, but the water permeability of the spur dike exceeds the water permeability range, the control platform making the whole spur dike denser to reduce the water permeability through an adjustment to the positions of each movable rail and the movable water-permeable piles thereon, including decreasing the distance between the movable rails, that is, moving the movable water-permeable piles on each movable rail close to the fixed rail to decrease the spacing of the water-permeable movable piles on two movable rails, or increasing the number of the movable water-permeable piles in the spur dike.

Compared with the prior art, the present disclosure has the following the beneficial effects: (1) The water-permeable piles are hollow piles, and have permeable holes with different diameters front and rear alternately arranged on the upstream and downstream faces, thus the water flow passes through the permeable holes of each pile, reducing the flow around the spur dike head and influencing 3D flow field distribution rule of the water flow at the spur dike head and near the dike body, with an effective decrease in the partial maximum flow velocity of the dike head at the axis of the spur dike, which reduces scouring the spur dike head and the hollowing out the dike body foundation with benefit to stably arrange the dike body, and also reduces affecting on the river ecological environment owing to the built spur dike, alleviating the partition between aquatic organisms and bank slopes to a certain extent. (2) The spur dike is formed by grouping movable water-permeable piles at the bottom of which the rollers have a simple structure performing as a pile-fixing clamp, which can move and stop in real time, and has the bottom of each group embedded with four-sided hollow pyramids made of metal material sinking with the bottom into the river bed, increasing the contact surface between the bottom of the spur dike and the river bed, and enhancing the stability of the dike body. (3) The length of the spur dike can be determined by using a reasonable number of movable water-permeable based on the actual situation of a river, or by arranging several rows of multiple water-permeable pile groups to form a movable water-permeable pile spur dike group, so that each water-permeable pile group is front and rear alternately arranged to make use of the water flow area between the spur dikes for mixture and energy dissipation. (4) After the spur dike is removed, the components therefrom can also be recycled, reducing the waste of building materials and engineering losses. (5) By means of pressure sensors, water flow velocity monitoring devices and other technical means, we can obtain changes of a river, and feedback the data signal to the control platform on the river bank, enabling the control platform to achieve the reasonable movement of the water-permeable piles according to an operation method, make full use of the self-adaptive adjustment capability of the movable water-permeable spur dike, change the water permeability of the spur dike and the shape of the dike body, and form an effective response mechanism to the changes of the river.

BRIEF DESCRIPTION OF THE DRAWINGS

FIG. 7 is a structure diagram of the pile-fixing clamp being adsorbed within one example of the movable water-permeable pile spur dike according to the present disclosure.

FIG. 8 is a structure diagram of the pile-fixing clamp not being adsorbed within one example of the movable water-permeable pile spur dike according to the present disclosure.

DETAILED DESCRIPTION OF SOME EMBODIMENTS

Figure 1:
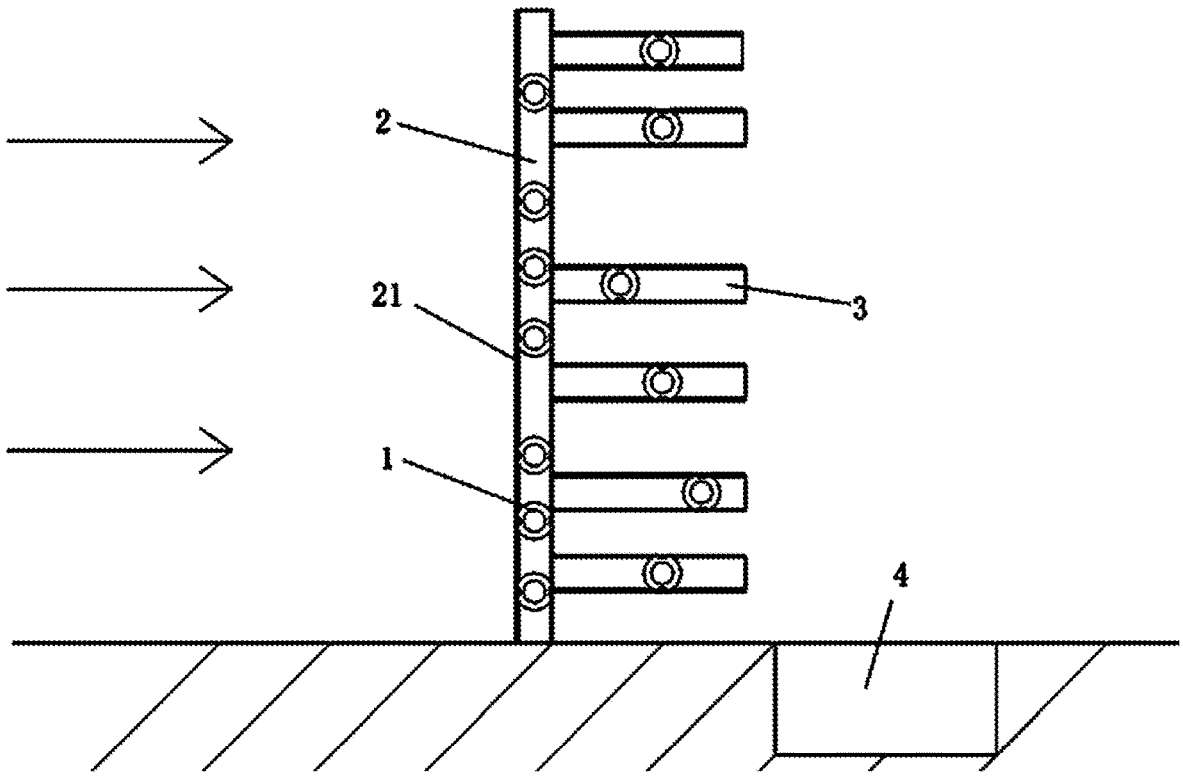
FIG. 1 is a top view of one example of the movable water-permeable pile spur dike according to the present disclosure.
Figure 2:
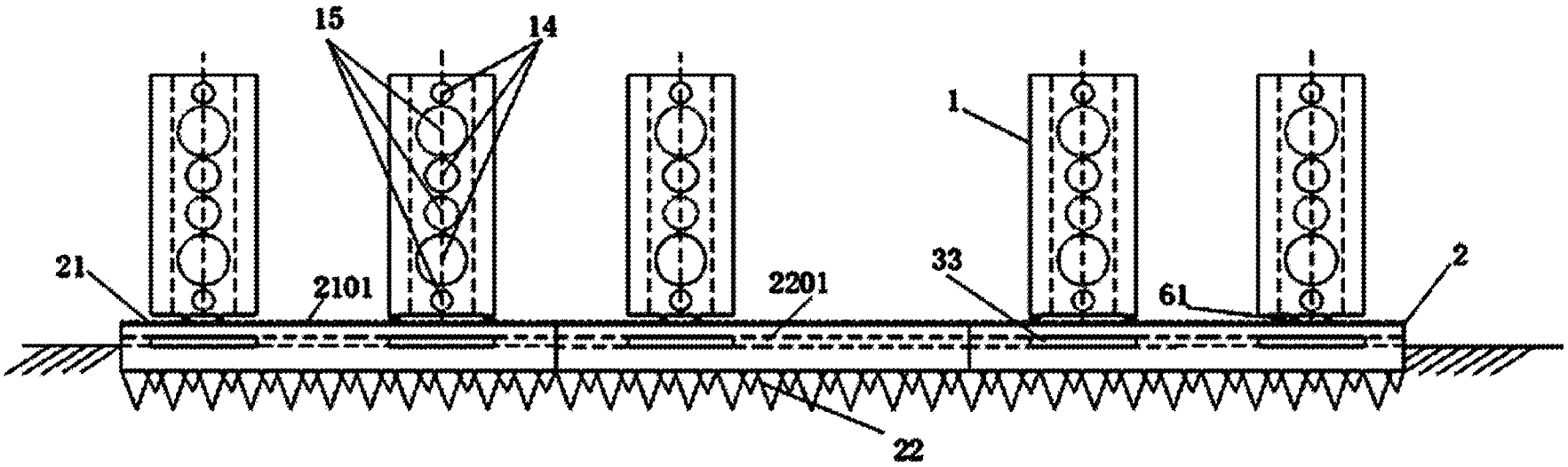
FIG. 2 is a front view of one example of the movable water-permeable pile spur dike according to the present disclosure.
Figure 3:
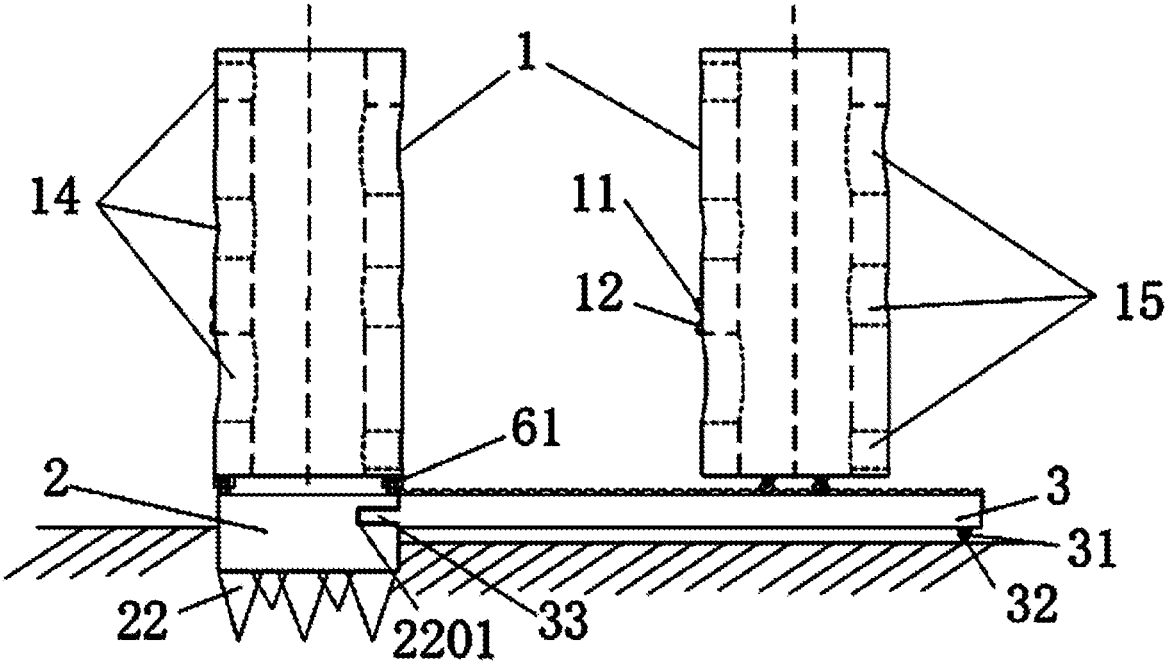
FIG. 3 is a side view of one example of the movable water-permeable pile spur dike according to the present disclosure.
Figure 4:
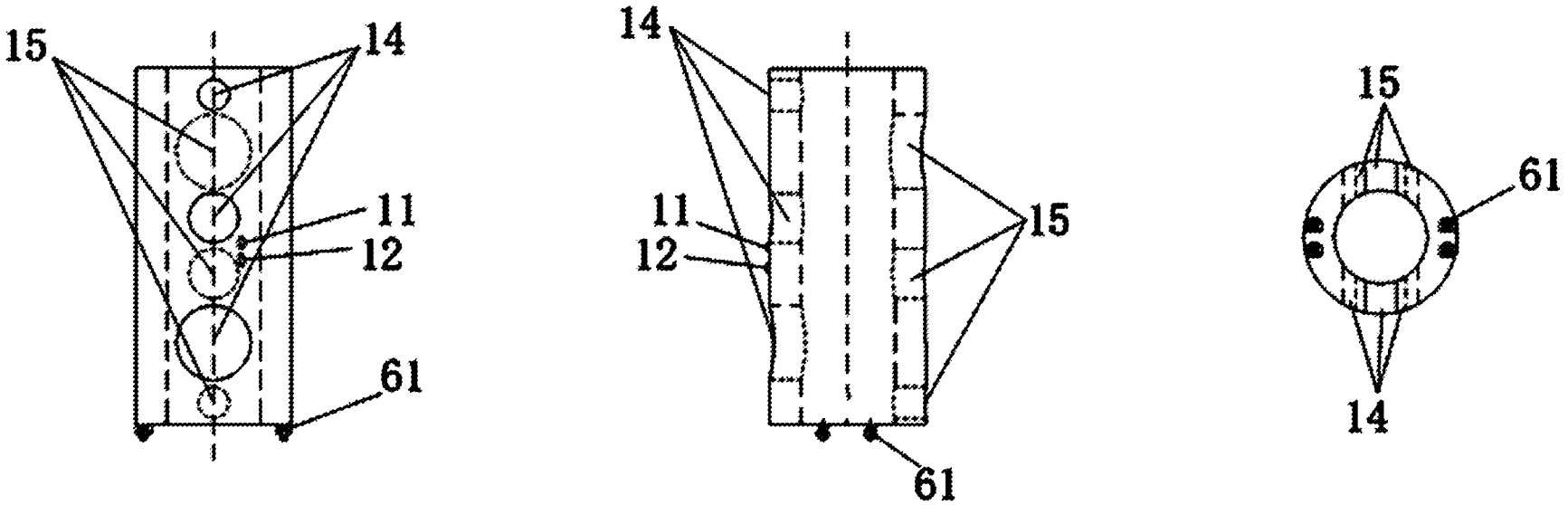
FIG. 4 is a structure diagram at different sides of the water-permeable pile within one example of the movable water-permeable pile spur dike according to the present disclosure.
Figure 5:
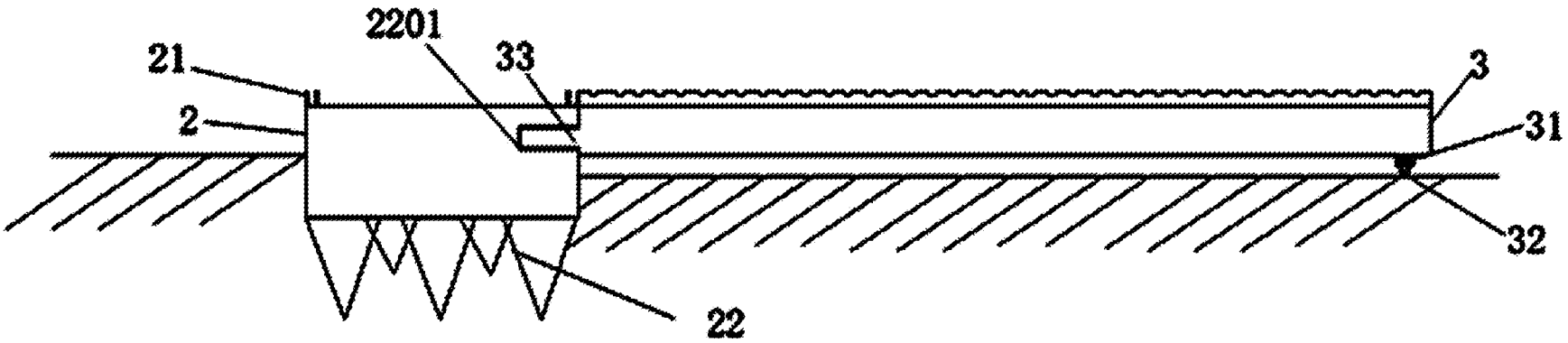
FIG. 5 is an overall side view of the fixed rail and the movable rail within one example of the movable water-permeable pile spur dike according to the present disclosure
Figure 6:
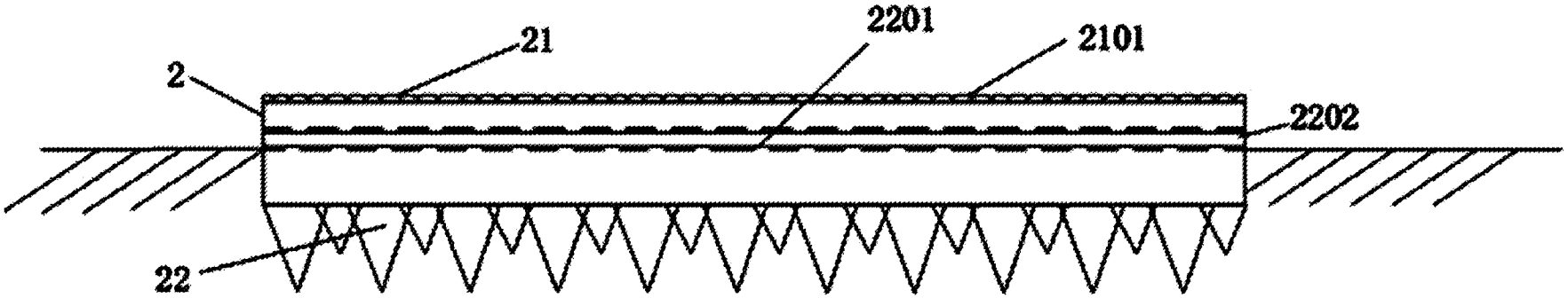
FIG. 6 is a structure diagram of the fixed rail within one example of the movable water-permeable pile spur dike according to the present disclosure.

We shall further describe the present disclosure as follows in combination with the drawings and specific examples, but the protection scope of the present disclosure is not limited to the enumerated examples.

As shown in FIGS. 1-6, this example provides a movable water-permeable pile spur dike, which includes a horizontally arranged fixed rail 2, a plurality of movable rails 3, a plurality of movable water-permeable piles 1, pressure sensors 11, flow meters 12 and a control platform 4, wherein the fixed rail is fixed on the river bed in the direction perpendicular to the water flow. One end of each movable rail 3 is slidably connected to one side of the downstream face of the fixed rail 2, and can move relatively in the extending direction of the fixed rail 2. The plurality of movable water-permeable piles 1 are arranged on the fixed rail 2 and the plurality of movable rails 3. The pressure sensors 11 and the flow meters 12 are arranged at each monitoring point on the outer side wall of each movable water-permeable pile 1, and respectively used to monitor the changes in the water pressure on each monitoring point and the changes in the water flow velocity about it. Each movable rail 3, each movable water-permeable pile 1, the pressure sensors 11 and the flow meters 12 are respectively connected to the control platform 4 in a communication mode, which is used for analysis and calculation according to the monitoring data from each pressure sensor 11 and each flow meter 12 and adjusts the positions of each movable rail 3 and each movable water-permeable pile 1, so that the water flow velocity and spur dike's pressure at each monitoring point are less than a corresponding flow velocity threshold value and pressure threshold value, and the spur dike's water permeability falls within the setting range. In addition, the spur dike body extends successively in the direction perpendicular to the water flow from the river bank to the center of the river channel, and the control platform 4 can be arranged at the river bank. The number and the height of the permeable water-piles required for the spur dike body can be selected according to the flow of the river. If there are large river flow, high average annual water depth, big water flow velocity in flood season or the spur dike is under high water pressure, the number of the water-permeable piles on the fixed rail and movable rails of the spur dike can be increased, or the water-permeable pile with larger diameter and height can be used to enhance the stability and the trajectory bucket effect of the spur dike.

Each movable water-permeable pile 1 includes a hollow cylinder, that is a cylindrical concrete pile whose interior is hollowed out. Each movable water-permeable pile 1 has the arc-shaped upstream face with 3 permeable holes whose diameters increase from top to bottom on its center line, as well as the arc-shaped downstream face with 3 permeable holes whose diameters decrease from top to bottom on its center line, and the permeable holes on each face may be set as a combination of permeable holes with multi-diameters of 50 cm, 20 cm, and 10 cm. The permeable holes on both faces of the water-permeable pile penetrate through the water-permeable pile to its hollow, and the permeable holes on both face are completely alternately arranged in the vertical direction. In this way, the water flow passes through the permeable holes of each pile, reducing the flow around the spur dike head and influencing 3D flow field distribution rule of the water flow at the spur dike head and near the dike body, with an effective decrease in the partial maximum flow velocity of the dike head at the axis of the spur dike, which reduces scouring the spur dike head and the hollowing out the dike body foundation with benefit to stably arrange the dike body, and also reduces affecting on the river ecological environment owing to the built spur dike, alleviating the partition between aquatic organisms and bank slopes to a certain extent.

In order to realize the movement of the movable water-permeable pile 1 along the fixed rail 2 and the movable rails 3, the upper surfaces of the fixed rail 2 and each movable rail 3 are provided with a pile-sliding groove 21, and the pile-sliding groove 21 is respectively arranged on the upper surface of the fixed rail 2 or the movable rail 3 along two parallel lines, and two sides of the pile-sliding groove 21 are provided with symmetrical tooth-shaped grooves 2101. The bottom of each water-movable permeable pile 1 is provided with two rows of pile roller groups, each of which corresponds to one pile-sliding groove 21, and each of which includes two pile roller units. Each pile roller unit includes a connector, a pile roller 61 and an electromagnetic group 6301. The pile roller 61 is also provided with a pile-fixing clamp 63. Specifically, of the connector, the top is embedded on both sides of the bottom of the corresponding mobile water-permeable pile 1, the middle part is a hollow connecting block 6203 used to arrange a driver and the electromagnetic group 6301, and the two ends of the bottom extend downwards to form connecting pieces 6202, both of which are connected by a connecting rod 6201. The connecting rod 6201 passes through the center of the pile roller 61, as shown in FIGS. 7 and 8. ⅓ of the pile roller 61 sinks into the pile-sliding groove on both sides of each fixed rail and movable rail, and the remaining ⅔ of the roller is unrestrained by the groove. The pile-fixing clamp 63 is composed of a telescopic chain net made from elastic wear-resistant material (for example, elastic and wear-resistant metal materials or plastic products) and U-shaped bent iron sheets 6302 connected to both ends of the net, and the two ends of each U-shaped bent iron sheet 6302 are respectively sleeved on the connecting rod 6201, and can rotate around the connecting rod 6201. The sides of the two straight ends of each U-shaped bent iron sheet 6302 are fan-shaped, so as to be coordinated with the outer circumference of the pile roller 61, but separated from it by a certain distance. The electromagnetic group 6301 is arranged inside the hollow connecting block 6203 of the connector and connected with the control platform 5 in a communication mode. The power-on state of the electromagnetic group is controlled according to the command sent by the control platform, so as to control the operation state of the pile-fixing clamp 63, so that the water-permeable pile can be stopped immediately during movement. Specifically, if required to control the normal movement of the designated water-permeable pile 1, the electromagnet in the electromagnet group 6301 is energized, and the two U-shaped bent iron sheets 6302 have the angle between them created at 30 degrees and are stably arranged above the pile roller 61, thus the telescopic chain net shrinks into a straight state, and the pile roller 61 moves smoothly in the rail under the control of the control platform 4. If required to control the stop of the designated water-permeable pile 1, the driver stops driving the pile roller 61, meanwhile the electromagnetic group 6301 is in a power-off state, and the two U-shaped bent iron sheets 6302 fall into the tooth-shaped grooves 2101 in the rotation direction away from each other under the action of gravity, the telescopic chain net 6303 spreads out and covers the surface of the pile roller 61, increasing the frictional resistance of the pile roller 61 and slowing down the movement speed of the pile roller 61. At this time, the pile roller 61 is blocked, and the movable water-permeable pile 1 stops moving on the corresponding rail, as shown in FIG. 8. In this way, the pile roller 61 is connected with the pile-fixing clamp 63 and installed at the bottom of the water-permeable pile 1, so that the water-permeable pile can move freely on the fixed rail or the movable rail. Preferably, the electromagnetic group is arranged inside the hollow connecting block 6203 of the connector above the two U-shaped bent iron sheets 6302, and its structure is simple and the stability effect is good. In addition, in other examples, the number of the pile-sliding grooves can be more than two, the number of the pile roller groups can also be increased accordingly, and the number of the pile roller units in each row of the pile roller groups can also be adjusted and changed.

Preferably, reinforced concrete can be poured to form the main body of the fixed rail 2, ½ of which sinks in the river bed, and the lower surface of which is provided with a plurality of four-sided hollowed-out pyramids 22 sinking in the river bed. Each four-sided hollowed-out pyramid 22 is positioned with its pyramid tip downwards, and its quadrilateral bottom surface is embedded in the lower surface of the fixed rail 2, connected with the reinforced concrete inside it, and has a pyramided outer frame formed by metal wires. Each hollowed out surface also has a plurality of metal wires wound across its edges. The above-mentioned plurality of four-sided hollowed-out pyramids 22 are arranged along such three straight lines, as the edges of the corresponding fixed rail and the central axis of the long end, and the four-sided hollowed-out pyramids along the two adjacent straight lines are alternated with each other, so this structure can increase the contact area with the river bed and have an advantage to stabilize the spur dike body.

The ½ height of the downstream face of the fixed rail 2 is horizontally cut inwards to form a groove 2201 whose vertical side is provided with a movable rail groove 2202. One end connecting each movable rail 3 to the fixed rail 2 is provided with a moving slider 33, and the bottom of one end away from the fixed rail is provided with a movable rail roller 31, which is inlaid into the movable rail groove 2202 inside the groove 2201 and can move in the movable rail groove 2202 inside the groove 2201. The movable rail roller 31 is connected with the control platform 4 in a communication mode, and can roll along the matched convex single rail 32 fixed on the river bed under the control of the control platform, thereby driving the moving slider 33 to slide smoothly in the vertical water flow direction, so as to adjust the position of the corresponding movable rail 3. The convex single rail 32 is parallel to the fixed rail and used to move the movable rail, so that the sediments carried by the water flow will not hinder the movable rail roller 31 from rolling.

Figure 10:
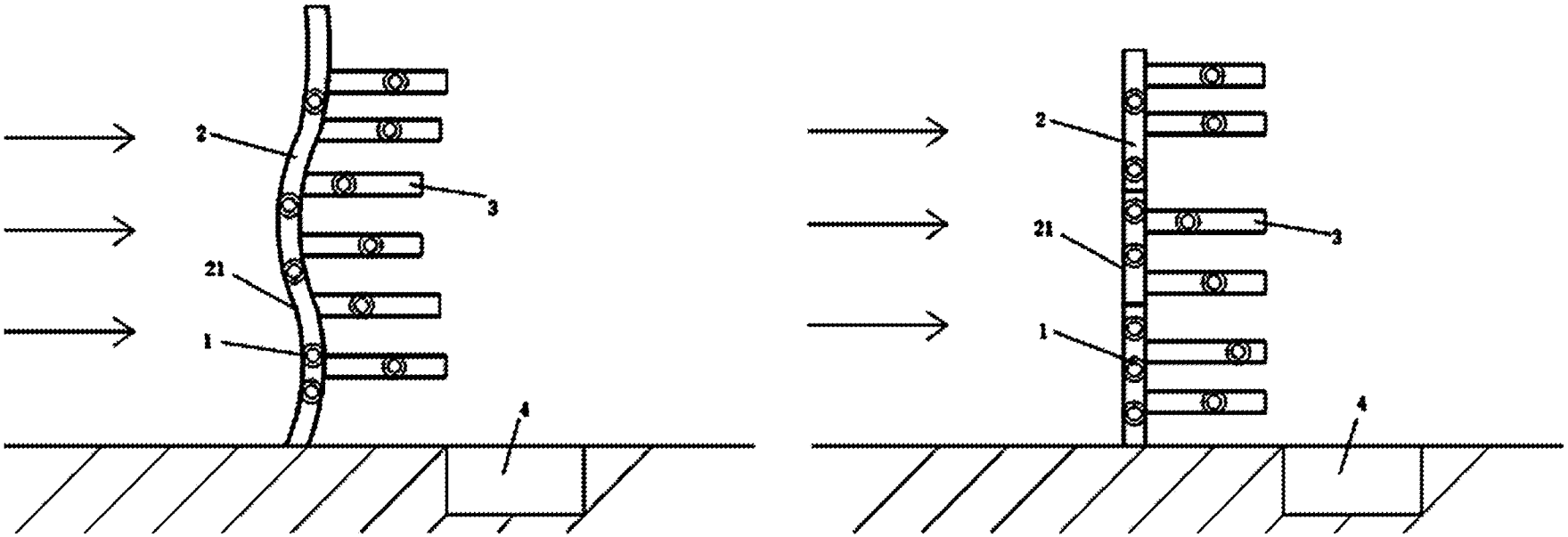
FIG. 10 is a structure diagram of various fixed rails used in another examples of the movable water-permeable pile spur dike according to the present disclosure.

In this example, the fixed rail 2 is an integrally-formed linear rail. It should be noted that, in other examples, the fixed rail 2 can also be an irregular broken-line rail, a curved rail, or a linear rail, a broken-line rail or a curved rail formed by splicing multiple segments of straight sub-rails, as shown in FIG. 10.

In this example, the control platform 4 is arranged on the river bank, including a signal transmission device, a control system and some electromechanical equipment. The signal transmission device receives the data signals coming from the pressure sensors and the flow meters, and then transmits them to the control system, which will analyze and process the received data signal of the river changes and the situation of the spur dike partially bearing pressure to make an appropriate adjustment plan for the water-permeable pile spur dike, and then the control platform sends instructions to the electromechanical equipment, thereby moving the movable water-permeable piles to make an appropriate adjustment step, so as to change the water permeability of the spur dike body and the spur dike shape, replying the changes in the river and the spur dike. In other examples, the control platform 4 can also be arranged at other positions, and contain some electromechanical equipment that can also be installed at appropriate positions on the spur dike after waterproofing, for example, near the movable rail roller 31 or the pile roller 61.

The spur dike is arranged in the river, so that the water flow is respectively divided by ways of flowing around the dike head, passing through the water-permeable piles, and penetrating through the free flow area between the permeable piles. The permeable piles of the spur dike can move freely on each rail.

In the dry season of a river, in the case that the pressure and flow values of the spur dike are within a corresponding preset threshold value, the required water permeability range is smaller than that in the flood season, providing a certainty to decrease the distance $L_i$ between the permeable piles and the water permeability a of the spur dike, improve a water-blocking effect and bank up the water level, and an advantage to maintain the navigable water depth of the river. In the case that the water pressure partially borne by the spur dike is gradually more than the threshold value H, the spur dike's pressure P increase so as to seriously scour the partial permeable pile foundation, having a disadvantage to stabilize the dam itself. By simulation-optimization calculation, we know that the water permeability a of the spur dike needs to be increased. When both the pressure and flow velocity of the spur dike are less than the preset threshold value in the control system, the control platform 4 simulates the optimal water permeability of the spur dike to increase the distance between the partial fixed rail piles through the signal transmission device, thereby enhancing the flow capacity of dike body and reducing the partial pressure borne by the spur dike. At the same time, the water-permeable piles on the partial movable rail is reduced in the distance to the fixed rail, with the distance increased between the parallel movable rails, thereby enhancing the overall compressive strength of the spur dike and ensuring the stability and the effective operation effect of the spur dike.

In the flood season of the river, according to the measured hydrologic data in the early flood season of previous years, an optimized plan had been deduced in advance for arrangement, providing a certainty to previously increase the number of the water-permeable piles on the rail. With the approach of the river flood season, the river flow increases, in the case that the spur dike's pressure or the flow velocity exceeds the corresponding preset threshold value, the control platform receives a current warning data signal, and simulates and predicts an optimal plan to adjust the dike body, that is, the spacing $L_i$ between the piles in the middle section of the spur dike body is increased, and the movable rails are moved to the horizontal centerline between the adjacent piles, appearing in an alternate arrangement. The piles on the movable rail move away from the fixed rail to enhance the flow capacity of the spur dike body, alleviate scouring the dike head, and stabilize the spur dike body, so that the water pressure and the flow velocity borne by the spur dike body are gradually less than the preset threshold value.

Therefore, the present disclosure also provides an operation method of the movable water-permeable pile spur dike, comprising the following steps:

(S1) performing statistical analysis based on each inter-annual or annual data results of rivers, setting the water permeability range of the movable water-permeable pile spur dike and the initial position of the plurality of movable water-permeable piles 1 and the plurality of movable rails 3, arranging the control platform 4 according to the initial position, and controlling and adjusting the plurality of movable water-permeable piles and the plurality of movable rails to form the movable water-permeable pile spur dike in its initial state;

(S2) each flow meter 12 monitoring the flow velocity of water flow that includes longitudinal flow velocity $u_x$ and lateral flow velocity $u_y$, at its monitoring point of the spur dike in real time; of each flow meter, a sampling interval period being denoted by Δt, a monitoring period being denoted by T, an average longitudinal flow velocity value within the monitoring period T being denoted by $U_x$, and an average transverse flow velocity value being denoted by as $U_y$; each flow meter 12 sending $U_x$ and $U_y$ to the control platform 4 as monitoring data; each of the pressure sensors 11 monitoring the pressure borne by it that includes hydrostatic pressure $P_1$ and hydrodynamic pressure $P_2$, at its monitoring point of the spur dike in real time; of each pressure sensor, a sampling interval period also being denoted by Δt, a monitoring period also being denoted by T, an average value of the sum of the hydrostatic pressure and the hydrodynamic pressure within the monitoring period T being denoted by P; each of the pressure sensors 11 sending P to the control platform 4 as monitoring data;

(S3) the control platform 4 calculating the real-time water permeability of the movable water-permeable spur dike based on the real-time monitoring data from each pressure sensor 11 and each flow meter 12 according to Formula:

$$a = \frac{\theta \times P \times K_a \times \Sigma L_i}{D_1 U}$$

wherein, a is the water permeability of the spur dike; $K_a$ is an error-correcting function, which is required to be determined by model tests and prototype observations; $\Sigma L_i$ is the sum of the water-permeable pile's spacing; U is the average water flow velocity of each monitoring point, which is calculated from the data collected by each flow meter, within each monitoring period; P is the average value, which is calculated from the data collected by each pressure sensor, of the sum of the hydrostatic pressure and the hydrodynamic pressure of the spur dike within each monitoring period; $D_1$ is the total length of the spur dike; θ is the water permeability of the water-permeable pile; and (S4) based on the real-time water permeability, the real-time monitoring data of each flow meter 12, and the real-time monitoring data of each pressure sensor 11, the control platform 4 adjusting the positional arrangement of the multiple movable water-permeable piles 1 and the plurality of movable rails 3, specifically including:

judging whether the water flow velocity U at each monitoring point and the pressure P borne by the spur dike within the current monitoring period are both less than a preset threshold;

if both are less than the preset threshold and the real-time permeability is within the water permeability range, keeping the spacing between the water-permeable piles unchanged, that is, the water permeability of the spur dike attaining the stability of the spur dike and having a good response mechanism to water flow;

if the flow velocity U or the spur dike's pressure P at one or more monitoring points within the current monitoring period is more than the preset threshold value, having a disadvantage to stabilize the spur dike, a simulation being done to gradually increase the spacing of the movable water-permeable piles 1 at the corresponding monitoring point until the water flow velocity U and the spur dike's pressure P at each monitoring point are less than the corresponding preset threshold value and the water permeability calculated by simulation falls within the water permeability range, then making an adjustment according to the final simulation results; if the flow velocity U or the spur dike's pressure P at each monitoring point is less than the preset threshold value, but the water permeability of the spur dike exceeds the water permeability range, the control platform 4 making the whole spur dike denser to reduce the water permeability through an adjustment to the positions of each movable rail 3 and the movable water-permeable piles 1 thereon, including decreasing the distance between the movable rails 3, that is, moving the movable water-permeable piles 1 on each movable rail 3 close to the fixed rail 2 to decrease the spacing of the water-permeable movable piles 1 on two movable rails, or increasing the number of the movable water-permeable piles 1 in the spur dike.

The movable water-permeable spur dike in the above-mentioned examples can also be applied to put together a spur dike group, providing a certainty to adjust the water permeability of each permeable spur dike and the shape of the spur dikes in the spur dike group respectively, so that the spur dike group can enhance a water blocking effect, decompose the impact force of the water flow on the spur dike body stage by stage and slow down the flow velocity of the water flow, so as to ensure that the trajectory bucket effect of the spur dike is good and the spur dike group is stable.

Figure 9:
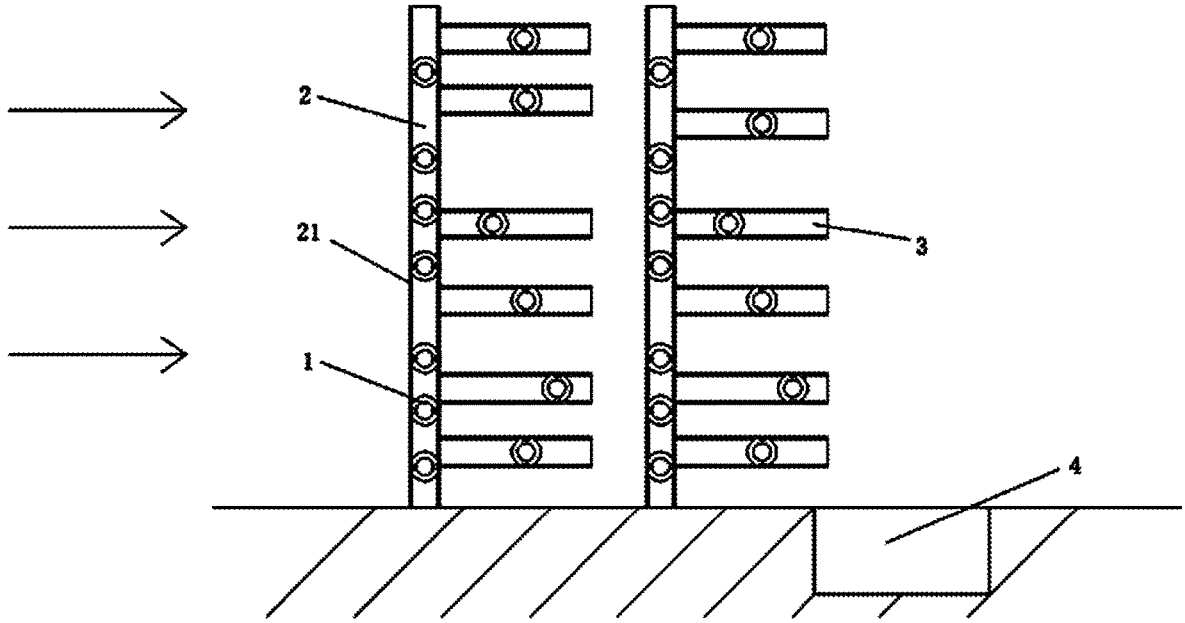
FIG. 9 is a top view of the movable water-permeable pile spur dikes arranged in a spur dike group according to the present disclosure.

As shown in FIG. 9, a group of movable water-permeable spur dikes is first completed by arranging and installing the movable permeable spur dikes in equal length and at equidistant intervals stage by stage in this example. As followed by the movement adjustment way of the first spur dike the same with this example, the water flow having passed through the previous spur dike all generates the flow velocity and pressure value borne by the subsequent spur dike, and then the measured data value is fed back to the control system for analysis and processing. As analogized from the operation method of movable permeable spur dike at each stage the same as that in this example, to the influence produced by water flowing through the previous spur dike, the spur dikes at each stage in the spur dike group can provide an adjustment plan about the permeable piles of the dike body with data values less than the preset threshold value, so that the spur dike group has a good practical effect in the river.

The above examples do not impose limitations on the present disclosure, and the present disclosure is not limited to the above examples. Any changes, modifications, additions or substitutions within the scope of the present disclosure made by a person skilled in the art also fall within the protection scope of the present disclosure.

What is claimed is:

1. A movable water-permeable pile spur dike, comprising a fixed rail (2), a plurality of movable rails (3), a plurality of movable water-permeable piles (1), pressure sensors (11), flow meters (12) and a control platform (4), wherein one end of each movable rail (3) is slidably connected to one side of a downstream face of said fixed rail (2), and is configured to move relatively in the extending direction of said fixed rail (2);

said plurality of movable water-permeable piles (1) are arranged on said fixed rail (2) and said plurality of movable rails (3);

said pressure sensors (11) and said flow meters (12) are arranged at each monitoring point on an outer side wall of each movable water-permeable pile (1) and respectively used to monitor the changes in the water pressure on each monitoring point and the changes in the water flow velocity about the monitoring point;

said plurality of movable rails (3), said plurality of movable water-permeable piles (1), each of said pressure sensors (11) and each of said flow meters (12) are respectively connected to said control platform (4) in a communication mode, which is used for analysis and calculation according to monitoring data from each of said pressure sensors (11) and each of said flow meters (12) and adjusts the positions of each movable rail (3) and each movable water-permeable pile (1), so that the water flow velocity and spur dike's pressure at each monitoring point are both less than a corresponding flow velocity threshold value and pressure threshold value, and the spur dike's water permeability falls within a setting range.

2. The movable water-permeable pile spur dike according to claim 1, wherein each movable water-permeable pile (1) comprises a hollow cylinder, of said hollow cylinder, an upstream face is provided with a plurality of upstream face permeable holes (14) whose diameters increase from top to bottom, and a downstream face is provided with a plurality of downstream face permeable holes (15) whose diameters decrease from top to bottom, each upstream face permeable hole (14) and each downstream face permeable hole (15) penetrate through said water-permeable pile to its hollow, and said upstream face permeable holes (14) and said downstream face permeable holes (15) are completely alternately arranged in the vertical direction.

3. The movable water-permeable pile spur dike according to claim 2, wherein upper surfaces of said fixed rail (2) and said plurality of movable rails (3) are provided with two or more than two pile-sliding grooves (21) arranged in parallel, two sides of each pile-sliding groove (21) are provided with toothed grooves (2101);

a bottom of each of said plurality of movable water-permeable piles (1) is provided with two or more than two rows of pile roller groups, each of which corresponds to one of the pile-sliding grooves (21), and each of which comprises one or more than one pile roller unit, each pile roller unit comprises a connector, a pile roller (61) and an electromagnetic group (6301), of said connector, a top is embedded inside said movable water-permeable pile (1), a middle part is a hollow connecting block (6203), and two ends of a bottom extend downwards to form connecting pieces (6202), both of which are connected by a connecting rod (6201), said connecting rod (6201) passes through the center of said pile roller (61), a pile-fixing clamp (63) is sleeved on said connecting rod (6201), said electromagnetic group (6301) is arranged in the hollow connecting block (6203) of said connector, said pile roller (61) and said electromagnetic group (6301) are connected with said control platform (4) in the communication mode, so as to be rolled and magnetically adsorb said pile-fixing clamp (63) under the control of said control platform (4), respectively;

in the case that said electromagnetic group (6301) has not magnetically adsorbed said pile-fixing clamp (63), said pile-fixing clamp (63) is embedded in said toothed grooves (2101) of its rail under the action of gravity, in the case that said electromagnetic group (6301) has magnetically adsorbed said pile-fixing clamp (63), said pile-fixing clamp (63) leaves said toothed grooves (2101).

4. The movable water-permeable pile spur dike according to claim 1, wherein upper surfaces of said fixed rail (2) and said plurality of movable rails (3) are provided with two or more than two pile-sliding grooves (21) arranged in parallel, two sides of each pile-sliding groove (21) are provided with toothed grooves (2101);

a bottom of each of said plurality of movable water-permeable piles (1) is provided with two or more than two rows of pile roller groups, each of which corresponds to one of the pile-sliding grooves (21), and each of which comprises one or more than one pile roller unit, each pile roller unit comprises a connector, a pile roller (61) and an electromagnetic group (6301), of said connector, a top is embedded inside said movable water-permeable pile (1), a middle part is a hollow connecting block (6203), and two ends of a bottom extend downwards to form connecting pieces (6202), both of which are connected by a connecting rod (6201), said connecting rod (6201) passes through the center of said pile roller (61), a pile-fixing clamp (63) is sleeved on said connecting rod (6201), said electromagnetic group (6301) is arranged in the hollow connecting block (6203) of said connector, said pile roller (61) and said electromagnetic group (6301) are connected with said control platform (4) in communication mode, so as to be rolled and magnetically adsorb said pile-fixing clamp (63) under the control of said control platform (4), respectively;

in the case that said electromagnetic group (6301) has not magnetically adsorbed said pile-fixing clamp (63), said pile-fixing clamp (63) is embedded in said toothed grooves (2101) of its rail under the action of gravity, in the case that said electromagnetic group (6301) has magnetically adsorbed said pile-fixing clamp (63), said pile-fixing clamp (63) leaves said toothed grooves (2101).

5. The movable water-permeable pile spur dike according to claim 4, wherein said pile-fixing clamp (63) comprises two U-shaped bent iron sheets (6302), two ends of each U-shaped bent iron sheet (6302) are respectively sleeved on said connecting rod (6201), and are configured to rotate around said connecting rod (6201), in the case that said electromagnetic group (6301) has not magnetically adsorbed said pile-fixing clamp (63), said two U-shaped bent iron sheets (6302), under the action of gravity, respectively, are embedded in said toothed grooves (2101) of their rails in the opposite direction.

6. The movable water-permeable pile spur dike according to claim 5, wherein sides of the two ends of each U-shaped bent iron sheet (6302) are triangular.

7. The movable water-permeable pile spur dike according to claim 5, wherein said two U-shaped bent iron sheets (6302) are connected with each other through a telescopic chain net, said telescopic chain net (6303) is made from elastic wear-resistant material, in the case that said electromagnetic group (6301) has magnetically adsorbed said two U-shaped bent iron sheets (6302), said telescopic chain net (6303) shrinks, in the case that said electromagnetic group (6301) has not magnetically adsorbed said two U-shaped bent iron sheets (6302), said telescopic chain net (6303) spreads out and covers the surface of said pile roller (61) after its ends are extended.

8. The movable water-permeable pile spur dike according to claim 1, wherein said fixed rail (2) is an irregular curved rail, or a broken-line rail formed by splicing multiple segments of straight sub-rails.

9. The movable water-permeable pile spur dike according to claim 1, wherein a lower surface of said fixed rail (2) is provided with a plurality of four-sided hollowed-out pyramids (22) configured to sink in a river bed, wherein a quadrilateral bottom surface of each said four-sided hollowed-out pyramid (22) is embedded in the lower surface of said fixed rail (2), and has a pyramided outer frame formed by metal wires, wherein each surface of each hollowed-out pyramid also has a plurality of metal wires wound across its edges, said plurality of four-sided hollowed-out pyramids (22) are arranged along three straight lines formed by two edges of the fixed rail and a central axis of the fixed rail, and the four-sided hollowed-out pyramids along two of the adjacent straight lines are alternated with each other.

10. The movable water-permeable pile spur dike according to claim 1, wherein one side of the downstream face of said fixed rail (2) is provided with a groove (2201) whose inside is provided with a movable rail groove (2202), one end of said movable rail connecting each movable rail (3) to said fixed rail (2) is provided with a moving slider (33), and a bottom of one end of said movable rail away from said fixed rail is provided with a movable rail roller (31), which is inlaid into said movable rail groove (2202) inside said groove (2201), said movable rail roller (31) is connected with said control platform (4) in the communication mode, and is configured to roll along a matched convex single rail (32) fixed on a river bed under the control of said control platform, thereby driving said moving slider (33) to slide, so as to adjust the position of the corresponding movable rail (3).

11. An operation method of the movable water-permeable pile spur dike according to claim 1, the method comprising the following steps:

(S1) performing statistical analysis based on each inter-annual or annual data results of rivers, setting the water permeability range of said movable water-permeable pile spur dike and the initial position of said plurality of movable water-permeable piles (1) and said plurality of movable rails (3), arranging said control platform (4) according to the initial position, and controlling and adjusting said plurality of movable water-permeable piles (1) and said plurality of movable rails (3) to form said movable water-permeable pile spur dike in its initial state;

(S2) each flow meter (12) monitoring the flow velocity of water flow that comprises longitudinal flow velocity ux and lateral flow velocity uy, at its monitoring point of the spur dike in real time; of each flow meter, a sampling interval period being denoted by Δt, a monitoring period being denoted by T, an average longitudinal flow velocity value within said monitoring period T being denoted by Ux, and an average transverse flow velocity value being denoted by Uy; each flow meter (12) sending Ux and Uy to said control platform (4) as monitoring data; each of said pressure sensors (11) monitoring the pressure borne by it that comprises hydrostatic pressure P1 and hydrodynamic pressure P2, at its monitoring point of the spur dike in real time; of each pressure sensor, a sampling interval period also being denoted by Δt, a monitoring period also being denoted by T, an average value of the sum of the hydrostatic pressure and the hydrodynamic pressure within said monitoring period T being denoted by P; each of said pressure sensors (11) sending P to said control platform (4) as monitoring data;

(S3) said control platform (4) calculating the real-time water permeability of said movable water-permeable spur dike based on the real-time monitoring data from each pressure sensor (11) and each flow meter (12) according to Formula (1):

$$a = \frac{\theta \times P \times K_a \times \Sigma L_i}{D_1 U}$$

wherein, a is the water permeability of the spur dike; $K_a$ is an error-correcting function, which is required to be determined by model tests and prototype observations; $\Sigma L_i$ is the sum of the water-permeable pile's spacing; U is the average water flow velocity of each monitoring point, which is calculated from the data collected by each flow meter, within each monitoring period; P is the average value, which is calculated from the data collected by each pressure sensor, of the sum of the hydrostatic pressure and the hydrodynamic pressure of the spur dike within each monitoring period; $D_1$ is the total length of the spur dike; θ is the water permeability of the water-permeable pile; and (S4) based on said real-time water permeability, said real-time monitoring data of each flow meter (12), and said real-time monitoring data of each pressure sensor (11), the control platform (4) adjusting the positional arrangement of said plurality of movable water-permeable piles (1) and said plurality of movable rails (3), specifically including:

judging whether the water flow velocity U at each monitoring point and the pressure P borne by the spur dike within the current monitoring period are both less than a preset threshold;

if both are less than said preset threshold and said real-time permeability is within the water permeability range, keeping the spacing between said water-permeable piles unchanged;

if the flow velocity U or the spur dike's pressure P at one or more monitoring points within the current monitoring period is more than said preset threshold value, conducting a simulation to gradually increase the spacing of the movable water-permeable piles (1) at the corresponding monitoring point until the water flow velocity U and the spur dike's pressure P at each monitoring point are less than the corresponding preset threshold value and the water permeability calculated by simulation falls within said water permeability range, then making an adjustment according to the final simulation results; if the flow velocity U or the spur dike's pressure P at each monitoring point is less than said preset threshold value, but the water permeability of the spur dike exceeds said water permeability range, said control platform (4) making the whole spur dike denser to reduce the water permeability through an adjustment to the positions of each movable rail (3) and said movable water-permeable piles (1) thereon, including decreasing the distance between said movable rails (3), that is, moving said movable water-permeable piles (1) on each movable rail (3) closer to said fixed rail (2) to decrease the spacing of said water-permeable movable piles (1) on the movable rails, or increasing the number of said movable water-permeable piles (1) in the spur dike.

12. The method of claim 11, wherein each movable water-permeable pile (1) comprises a hollow cylinder, of said hollow cylinder, an upstream face is provided with a plurality of upstream face permeable holes (14) whose diameters increase from top to bottom, and a downstream face is provided with a plurality of downstream face permeable holes (15) whose diameters decrease from top to bottom, each upstream face permeable hole (14) and each downstream face permeable hole (15) penetrate through said water-permeable pile to its hollow, and said upstream face permeable holes (14) and said downstream face permeable holes (15) are completely alternately arranged in the vertical direction.

13. The method of claim 11 wherein upper surfaces of said fixed rail (2) and said plurality of movable rail (3) are provided with two or more than two pile-sliding grooves (21) arranged in parallel, two sides of each pile-sliding groove (21) are provided with toothed grooves (2101);

a bottom of each of said plurality of movable water-permeable piles (1) is provided with two or more than two rows of pile roller groups, each of which corresponds to one of the pile-sliding grooves (21), and each of which comprises one or more than one pile roller unit, each pile roller unit comprises a connector, a pile roller (61) and an electromagnetic group (6301), of said connector, a top is embedded inside said movable water-permeable pile (1), a middle part is a hollow connecting block (6203), and two ends of a bottom extend downwards to form connecting pieces (6202), both of which are connected by a connecting rod (6201), said connecting rod (6201) passes through the center of said pile roller (61), a pile-fixing clamp (63) is sleeved on said connecting rod (6201), said electromagnetic group (6301) is arranged in the hollow connecting block (6203) of said connector, said pile roller (61) and said electromagnetic group (6301) are connected with said control platform (4) in the communication mode, so as to be rolled and magnetically adsorb said pile-fixing clamp (63) under the control of said control platform (4), respectively;

in the case that said electromagnetic group (6301) has not magnetically adsorbed said pile-fixing clamp (63), said pile-fixing clamp (63) is embedded in said toothed grooves (2101) of its rail under the action of gravity, in the case that said electromagnetic group (6301) has magnetically adsorbed said pile-fixing clamp (63), said pile-fixing clamp (63) leaves said toothed grooves (2101).

14. The method of claim 13 wherein said pile-fixing clamp (63) comprises two U-shaped bent iron sheets (6302), the two ends of each U-shaped bent iron sheet (6302) are respectively sleeved on said connecting rod (6201), and are configured to rotate around said connecting rod (6201), in the case that said electromagnetic group (6301) has not magnetically adsorbed said pile-fixing clamp (63), said two U-shaped bent iron sheets (6302), under the action of gravity, respectively, are embedded in said toothed grooves (2101) of their rails in the opposite direction.

15. The method of claim 14 wherein sides of the two ends of each U-shaped bent iron sheet (6302) are triangular.

16. The method of claim 14 wherein said two U-shaped bent iron sheets (6302) are connected with each other through a telescopic chain net, said telescopic chain net (6303) is made from elastic wear-resistant material, in the case that said electromagnetic group (6301) has magnetically adsorbed said two U-shaped bent iron sheets (6302), said telescopic chain net (6303) shrinks, in the case that said electromagnetic group (6301) has not magnetically adsorbed said two U-shaped bent iron sheets (6302), said telescopic chain net (6303) spreads out and covers the surface of said pile roller (61) after its ends are extended.

17. The method of claim 11 wherein said fixed rail (2) is an irregular curved rail, or a broken-line rail formed by splicing multiple segments of straight sub-rails.

18. The method of claim 11, wherein a lower surface of said fixed rail (2) is provided with a plurality of four-sided hollowed-out pyramids (22) configured to sink in a river bed, wherein a quadrilateral bottom surface of each said four-sided hollowed-out pyramid (22) is embedded in the lower surface of said fixed rail (2), and has a pyramided outer frame formed by metal wires, wherein each surface of each hollowed-out pyramid also has a plurality of metal wires wound across its edges, said plurality of four-sided hollowed-out pyramids (22) are arranged along three straight lines formed by two edges of the fixed rail and a central axis of the fixed rail, and the four-sided hollowed-out pyramids along two of the adjacent straight lines are alternated with each other.

19. The method of claim 11, wherein one side of the downstream face of said fixed rail (2) is provided with a groove (2201) whose inside is provided with a movable rail groove (2202), one end of said movable rail connecting each movable rail (3) to said fixed rail (2) is provided with a moving slider (33), and a bottom of one end of said movable rail away from said fixed rail is provided with a movable rail roller (31), which is inlaid into said movable rail groove (2202) inside said groove (2201), said movable rail roller (31) is connected with said control platform (4) in the communication mode, and is configured to roll along a matched convex single rail (32) fixed on a river bed under the control of said control platform, thereby driving said moving slider (33) to slide, so as to adjust the position of the corresponding movable rail (3).

* * * * *